US010000904B2

(12) United States Patent
Hurley

(10) Patent No.: US 10,000,904 B2
(45) Date of Patent: Jun. 19, 2018

(54) SECURING SYSTEM FOR BASKETBALL POLE

(76) Inventor: Alan R. Hurley, Gilbert, IL (US)

( * ) Notice: Subject to any disclaimer, the term of this patent is extended or adjusted under 35 U.S.C. 154(b) by 0 days. days.

(21) Appl. No.: 13/475,491

(22) Filed: May 18, 2012

(65) Prior Publication Data

US 2013/0305633 A1 Nov. 21, 2013

(51) Int. Cl.
*E02D 5/80* (2006.01)
*E04G 21/00* (2006.01)

(52) U.S. Cl.
CPC ..... *E02D 5/80* (2013.01); *E02D 5/801* (2013.01); *E04G 21/00* (2013.01)

(58) Field of Classification Search
CPC ..... A63B 63/083; A63B 2071/024
See application file for complete search history.

(56) References Cited

U.S. PATENT DOCUMENTS 4,714,225 A * 12/1987 Skinner ..... H01Q 1/1242 248/523
4,915,383 A * 4/1990 Yamakuchi ..... A63B 69/0013 473/499
5,013,045 A * 5/1991 Elmore ..... A63B 69/3647 473/229
5,158,281 A 10/1992 Williams
5,259,612 A 11/1993 Matherne et al.
5,326,109 A * 7/1994 Robl ..... A63B 61/02 473/492
5,377,976 A 1/1995 Matherne et al.
5,518,233 A 5/1996 Williams
5,902,197 A * 5/1999 Davis ..... A63B 63/083 473/479
5,924,933 A * 7/1999 Pacheco ..... A63B 69/36 473/216
5,983,602 A * 11/1999 Allen ..... A63B 63/083 473/479
6,287,220 B1 * 9/2001 Caruso ..... A63B 63/00 473/415
6,419,596 B1 * 7/2002 Dadbeh ..... A63B 63/083 473/472
6,776,734 B2 8/2004 van Nimwegen
6,786,842 B1 * 9/2004 Nasiatka ..... A63B 69/0013 473/499
7,185,871 B2 * 3/2007 Orozco ..... E02D 5/80 248/499

(Continued)

*Primary Examiner* — Elizabeth A Quast
(74) *Attorney, Agent, or Firm* — Law Office of Marc D. Machtinger, Ltd.

(57) ABSTRACT

A securing system for a portable basketball pole assembly is disclosed. The securing system includes ground screws which secure in the ground on either side of a base of the portable basketball pole assembly. A strap is extended from one ground member to the other over the base to hold the base securely to the ground and prevent tipping. Additional straps may be used to extend from the ground members to the pole to further secure the pole. In certain preferred embodiments, separate straps extend from the ground members to the pole. In other embodiments, a single strap is used. The straps are attached to the pole via a pole attachment member. The pole attachment member may conveniently be an after-market part which fits around an existing pole and provides a receiving element to receive the strap or straps. Buckles may be included to allow the straps to be tightened or loosened.

18 Claims, 7 Drawing Sheets

(56) References Cited

U.S. PATENT DOCUMENTS

| | | | | |
|---|---|---|---|---|
| 8,424,549 | B1 * | 4/2013 | Goldsmith | E04H 15/60 135/116 |
| 2002/0165049 | A1 | 11/2002 | Dadbeh | |
| 2003/0092514 | A1 * | 5/2003 | Nimwegen | A63B 63/08 473/481 |
| 2007/0200046 | A1 * | 8/2007 | Tota | E04H 12/2253 248/545 |
| 2012/0208682 | A1 * | 8/2012 | Kueckelhan | A63B 21/1476 482/131 |
| 2014/0243119 | A1 * | 8/2014 | Whalen | A63B 61/02 473/493 |

* cited by examiner

SECURING SYSTEM FOR BASKETBALL POLE

BACKGROUND OF THE INVENTION

1. Field of the Invention

The present invention relates to securing systems, and more particularly, to a securing system to secure a portable basketball pole assembly in place.

2. Background

It is a known problem that portable basketball pole assemblies are prone to tipping during use, or in windy conditions. A number of conventional methods for securing such poles have been proposed. However, none of them include sufficiently beneficial features which allow them to hold the pole in place securely enough, while being easy to install and convenient.

U.S. Pat. No. 5,158,281 issued to Williams discloses a basketball pole assembly which is anchored by a large barrel designed to contain a substance such as water. Such a large container is unsightly, space-consuming, and inconvenient. Furthermore, its effectiveness is limited by the weight of the substance it holds.

U.S. Pat. No. 5,518,233, also issued to Williams, shows another anchored portable basketball pole assembly with a different configuration. A large barrel is actually designed to fit around the pole. Again, this is space-consuming, inconvenient, and limited in effectiveness.

U.S. Pat. Nos. 5,259,612 and 5,377,976, both issued to Matherne et al., disclose a typical pole assembly with a base. The base is intended to hold a substance such as water to weight the base to secure the pole. However, this typical arrangement is insufficient to secure a pole, as is widely known.

In U.S. Pat. No. 6,776,734 issued to van Nimwegen, an anchoring system is proposed in which members pass through the base and fasten into a playing surface. First, one needs a specially designed base in order to use such a system. Secondly, in most applications, such basketball pole assemblies are positioned over dirt, and this system would not secure the pole very well in such conditions.

None of these prior devices provides an effective, convenient manner in which to secure a basketball pole assembly. Thus, the need remains for a highly effective and convenient system to secure portable basketball pole assemblies.

SUMMARY

The present invention is a securing system for a portable basketball pole assembly, and a method for securing a portable basketball pole assembly. The system of the present invention includes two ground securing members. In preferred embodiments, the ground securing elements are large screws with a hook or loop, or eye, at the top end.

The ground securing members are secured into the ground. For example, large screws are driven into the ground. The hook or loop remains above ground. One securing member is driven into the ground on one side of the base of a portable basketball pole assembly, and the other ground securing member is secured to the ground on the other side of the base.

A strap is then extended from one ground securing member, over the base, to the other ground securing member. In this way, the base is held securely to the ground and the pole is prevented from tipping to a great extent.

In various embodiments, the strap may be made of any suitable material. In certain embodiments, the strap is Nylon, and includes a buckle so as to allow the strap to be tightened or loosened. The strap may include hooks on each end to hook onto the ground securing screws. A cam-type strap may be used as the strap.

In certain other embodiments, two additional straps are provided to extend from each ground securing member to the pole, at a point raised above the base, to further secure the pole. These additional straps may be secured to the pole using any suitable method. In various embodiments, a pole attachment member is used. This member may include a metal part which fits around or substantially around the pole, and includes a receiving element to which the straps may be secured. In other embodiments, a hook or loop on the pole may be used to attach the straps.

In still further embodiments, a single pole strap can be used to extend from one ground member, around the pole or through a pole attachment member, and then to the other ground member. Alternatively, a single strap can be used to extend from the first ground member, over the base, through the receiving element of the second ground member, to the pole, either around the poll or through the pole attachment receiving element, and then back to the first ground member. Thus, a single strap can be used in this manner.

The present invention also includes a method for securing a portable basketball pole assembly. The method follows the steps involved in installing the system described above, as is detailed below.

While a portable basketball pole assembly can be specially designed to take advantage of the securing system of the present invention, it is understood that the securing system of the present invention can be conveniently applied as an after-market assembly which can be used with many different types of existing portable basketball pole assemblies.

Still other objects and advantages of the present invention will become readily apparent to those skilled in the art from the following detailed description, wherein it is shown and described only the preferred embodiments of the invention, simply by way of illustration of the best mode contemplated of carrying out the invention. As will be realized, the invention is capable of other and different embodiments and its several details are capable of modifications in various obvious respects, without departing from the invention. Accordingly, the drawings, wherein like reference numerals represent like features, and description are to be regarded as illustrative in nature and not as restrictive.

DETAILED DESCRIPTION OF THE INVENTION

Figure 1:
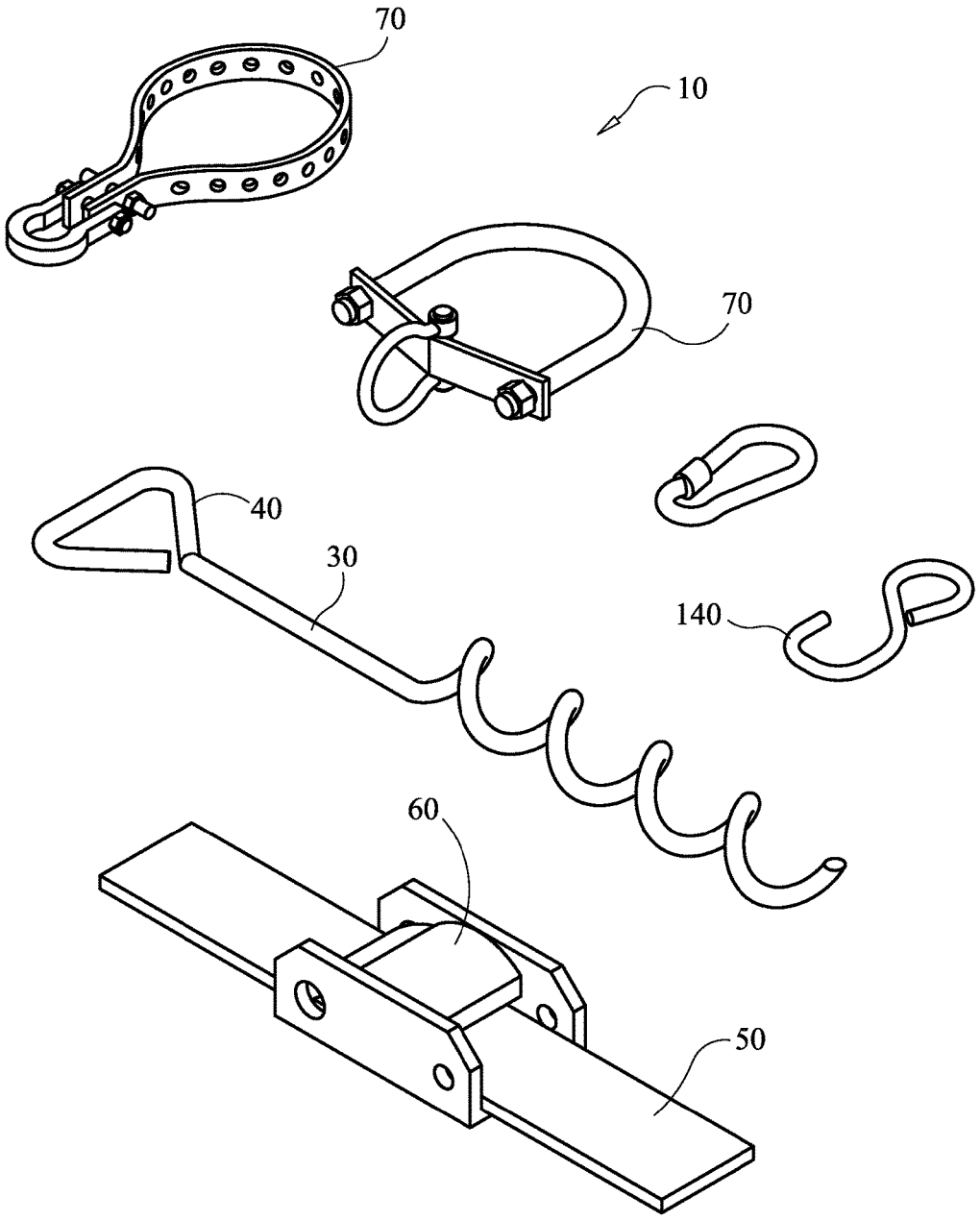
FIG. 1 shows an exploded view of various exemplary parts of the present invention.
Figure 2:
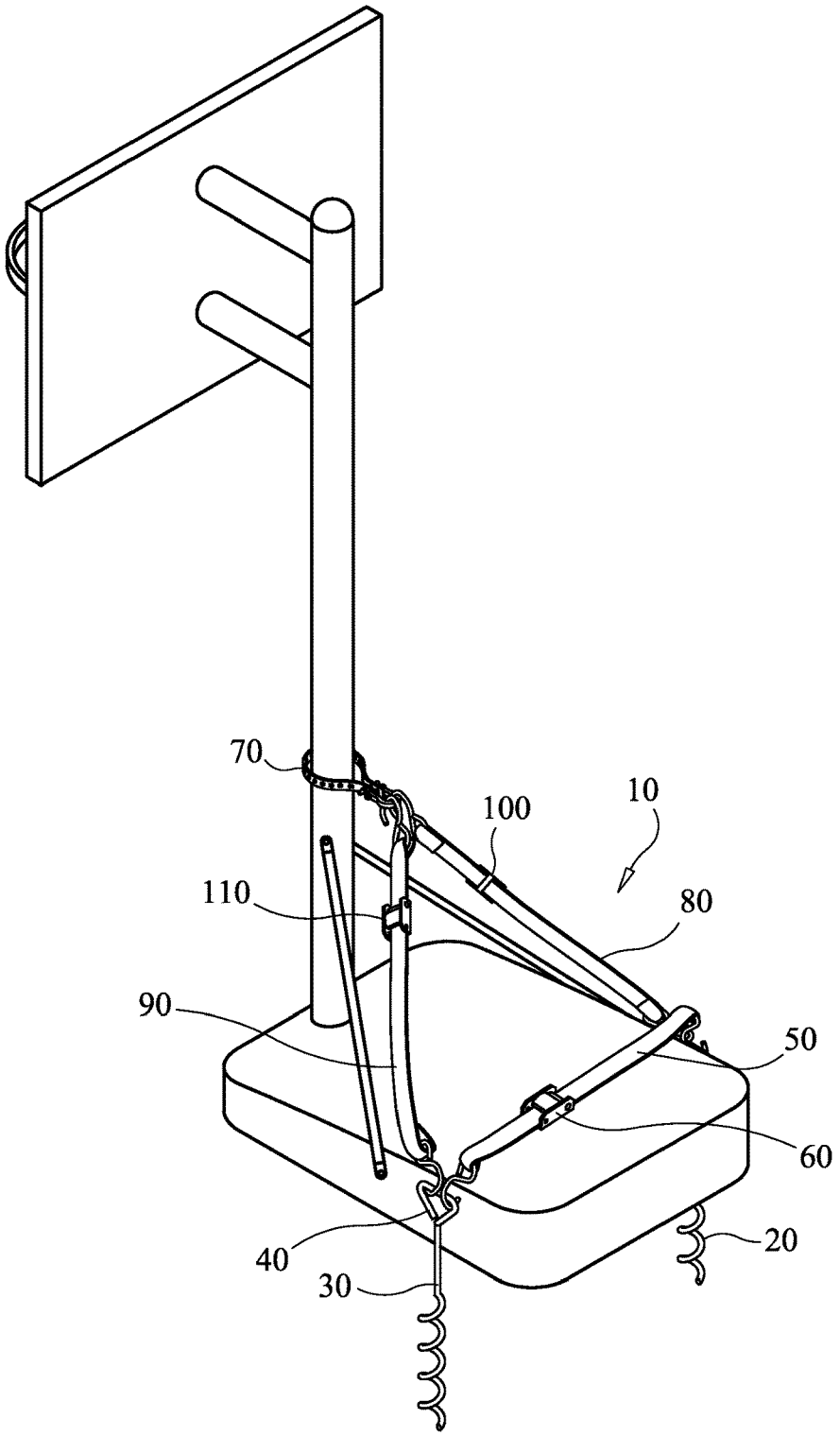
FIG. 2 shows a perspective view of one embodiment of the securing system of the present invention, as installed.
Figure 3:
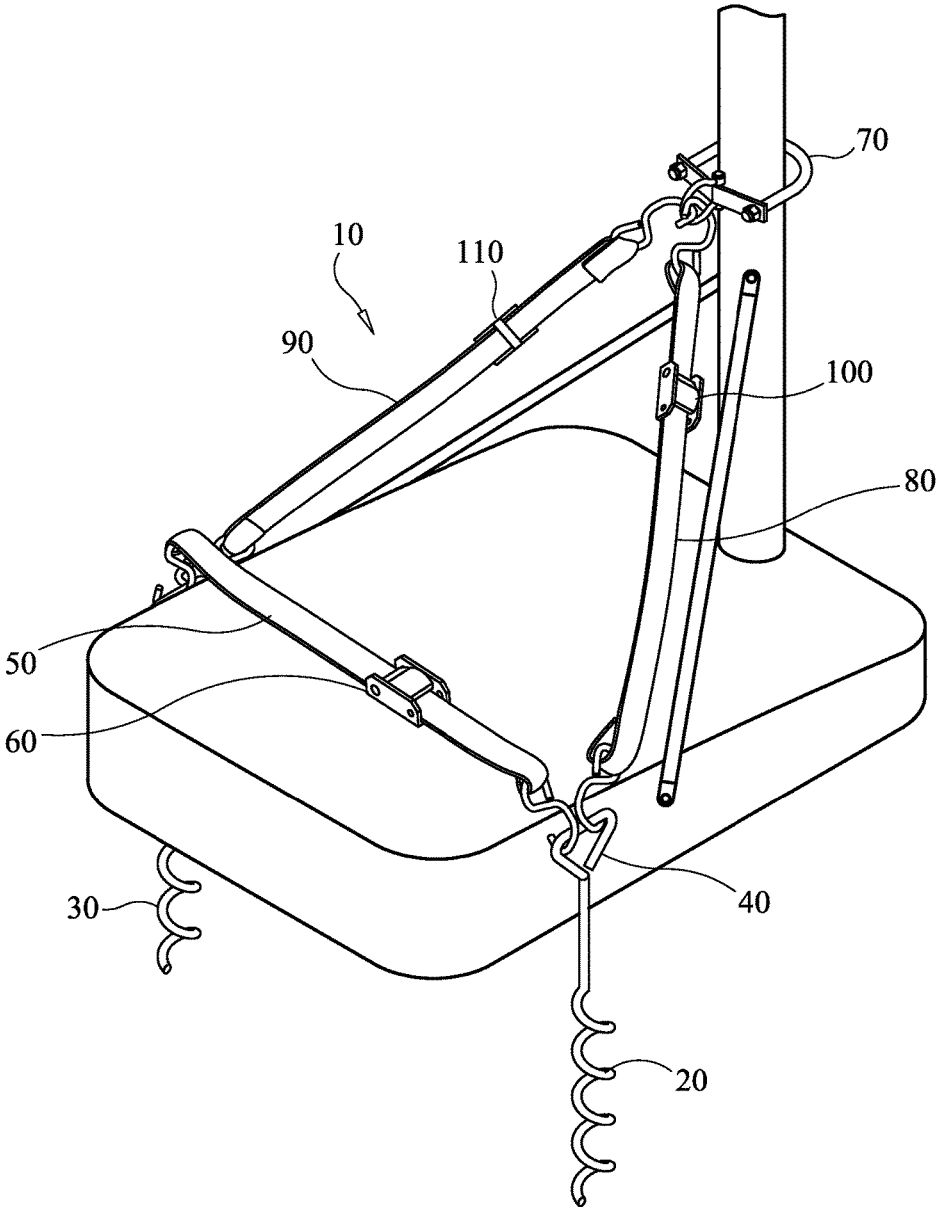
FIG. 3 shows a perspective view of another embodiment of the securing system of the present invention, as installed.
Figure 5:
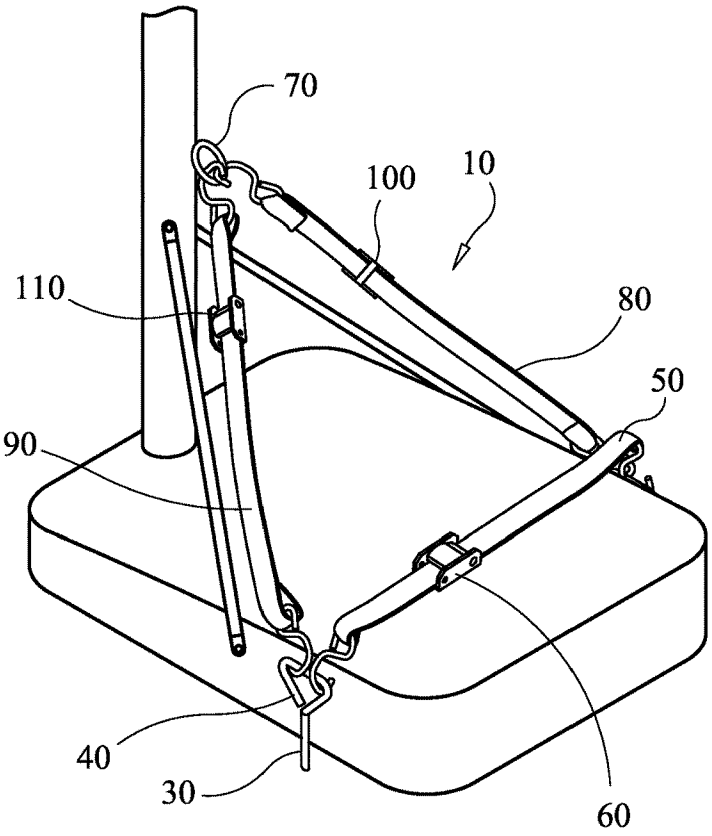
FIG. 5 shows a perspective view of another embodiment of the securing system of the present invention, as installed.

While this invention is susceptible of embodiments in many different forms, there are shown in the drawings and will herein be described in detail, preferred embodiments of the invention with the understanding that the present disclosure is to be considered as an exemplification of the principles of the invention and is not intended to limit the broad aspect of the invention to the embodiments illustrated.

The present invention a securing system 10 for a portable basketball pole assembly. FIG. 1 shows an exploded view of one set of exemplary components of the system of the present invention. However, it is understood that many variations in the components used would fall within the scope of the present invention.

In various embodiments, the system 10 includes a first ground securing member 20 adapted to be secured in the ground on one lateral side of a base of a portable basketball pole assembly. A second ground securing member 30 is adapted to be secured in the ground on a second lateral side of such a base of a portable basketball pole assembly.

The ground securing members 20 and 30 may be any suitable configuration so long as they can be secured into the ground. In certain embodiments, the ground securing members 20 and 30 are large screws which can be driven into the ground to hold securely. Each of the members 20 and 30 include a receiving element 40 disposed on a top portion. The receiving elements 40 may be hooks, loops, or other suitable elements which enable a strap to be attached thereto.

A strap 50 is adapted to attach to each receiving element 40 and extend from the first ground securing member 20 over such a base to the second ground securing member 30. The strap 50 is ideally attachable at a first end to the receiving element 40 of the first ground securing member 20, and attachable at a second end to the receiving element 40 of the second ground securing member 40. Any suitable attachment element may be used to secure the strap 50 to the ground securing members 20. For example, hooks 140, or snap hooks 150 to prevent detachment, or any other suitable component may be used.

In various embodiments, an auxiliary base strap 160 may be included for additional support. The auxiliary strap 160 extends over the base from additional ground securing members 170 and 180, which may be components similar to ground securing members 20 and 30, with receiving elements in the same manner.

The straps 50 or 160 may be any suitable material or configuration. In certain embodiments, the strap is a Nylon strap. They may be cam-type straps. Preferably, the straps 50 or 160 include a buckle 60, ideally having a thumb release so that the strap 50 or 160 can be tightened or loosened. The strap 50 or 160 may include hooks 140, or snap hooks 150 at either end to attach to the receiving elements 40.

In various embodiments, the securing system 10 for a portable basketball pole assembly includes an additional securing arrangement in which the pole is further secured. A pole attachment member 70 is attached to the pole at a point raised vertically from the base. The pole attachment member 70 may be a component which wraps at least substantially around the pole, or it may attach directly to the pole. It may be a metal component, or any other suitable material. The pole attachment member 70 may be a harness or fastener, which may attach to the pole such as an after-market part, or it may be permanently fastened to or formed with the pole, such as by welding, soldering, or other suitable manner of attachment. It may be a hook, loop, or any suitable component adapted for attachment to the pole and to a strap. In some embodiments, the pole attachment member 70 may be a screw eye which is driven into a hole in the pole. The hole may be provided by the manufacturer of the pole for this purpose, or may be formed after-market.

A first pole strap 80 extends from the first ground securing member 20 to the pole attachment member 70. A second pole strap 90 extends from the second ground securing member 30 to the pole attachment member 70. They are secured to the pole attachment member 70, either via hooks 140, snap hooks 150, or other mechanisms. These additional straps 80 and 90 may each include buckles 100 and 110 which can be used to tighten or loosen the straps 80 and 90.

The additional straps 80 and 90 may be of any suitable material or configuration, as strap 50 or different than strap 50. In certain preferred embodiments, the straps 80 and 90 are formed of Nylon, and may be cam-type straps.

In certain embodiments, instead of three separate straps 50, 80, and 90, a single strap 120 may be used to extend from the first ground securing member 20 over such a base through the receiving element 40 of the second ground securing member 30, and from the second ground securing member 30 around such a pole or through a pole attachment member 70, and then extending back to the first ground securing member 20.

Figure 4:
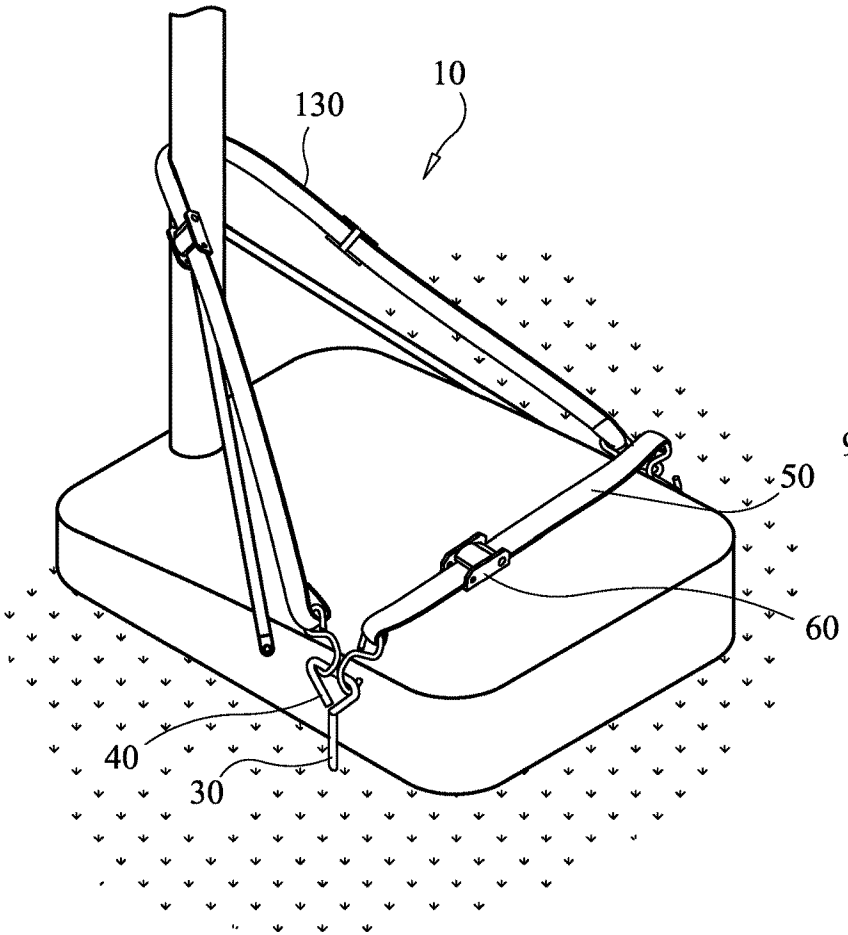
FIG. 4 shows a perspective view of another embodiment of the securing system of the present invention, as installed.
Figure 6:
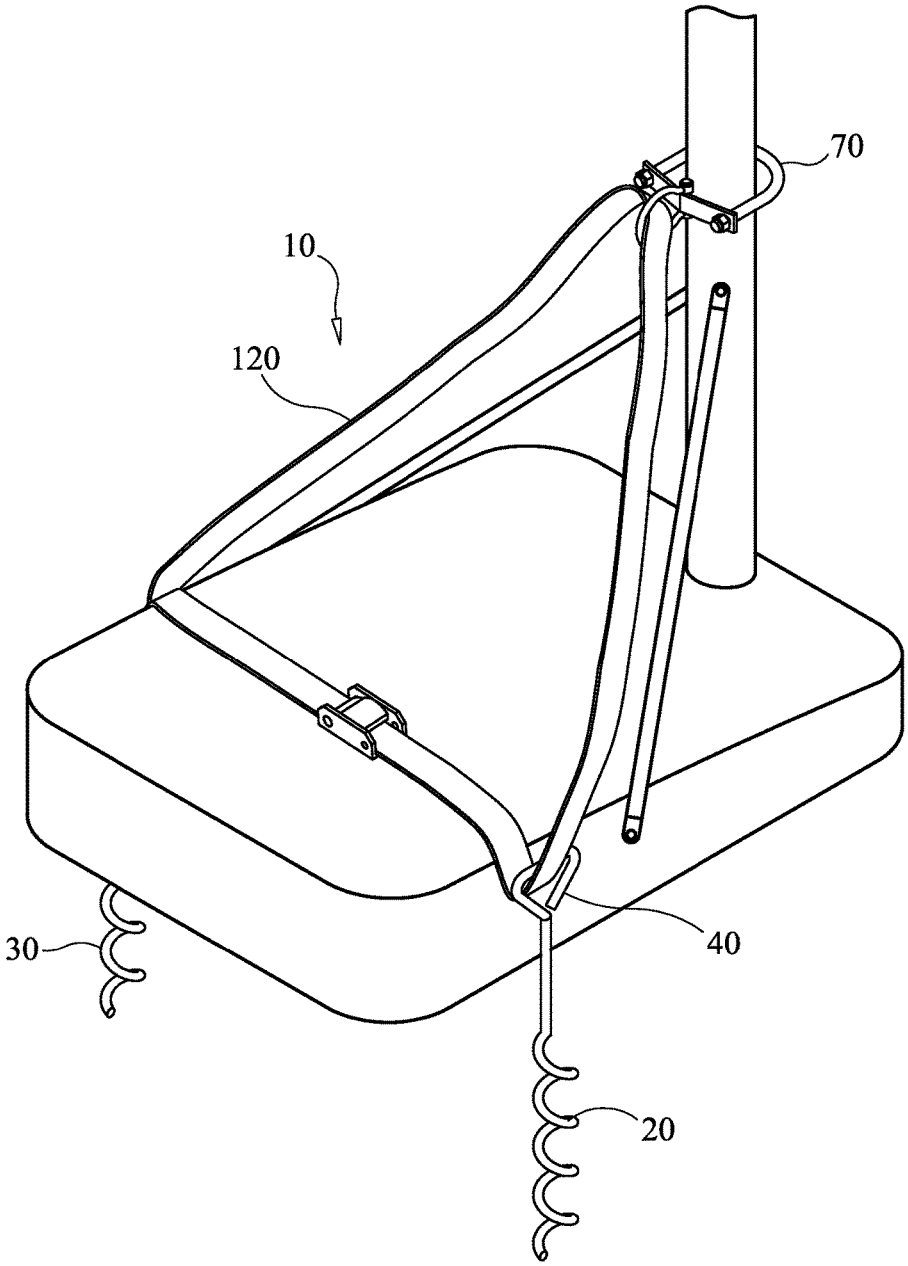
FIG. 6 shows a perspective view of another embodiment of the securing system of the present invention, as installed.
Figure 7:
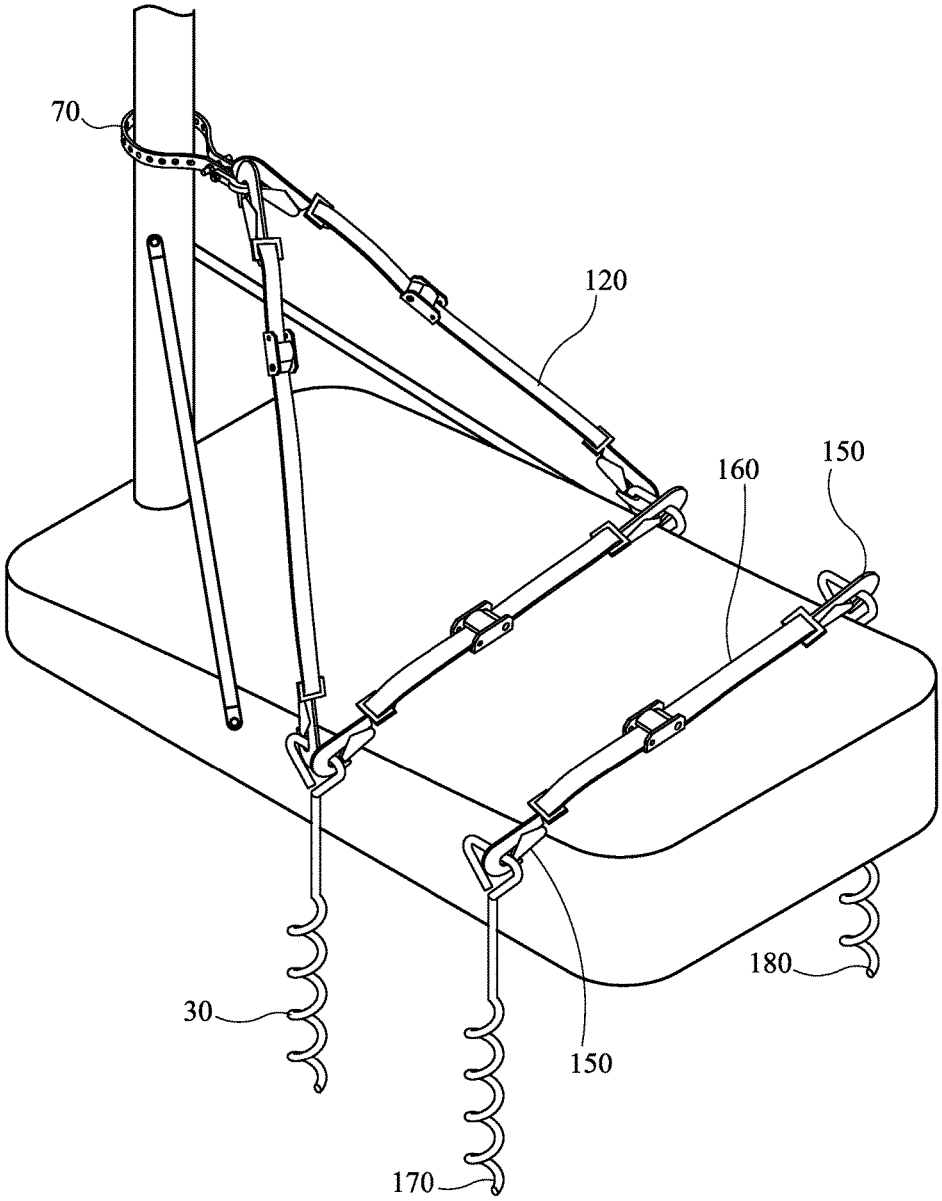
FIG. 7 shows a perspective view of another embodiment of the securing system of the present invention, as installed, with an additional base strap.
Figure 8:
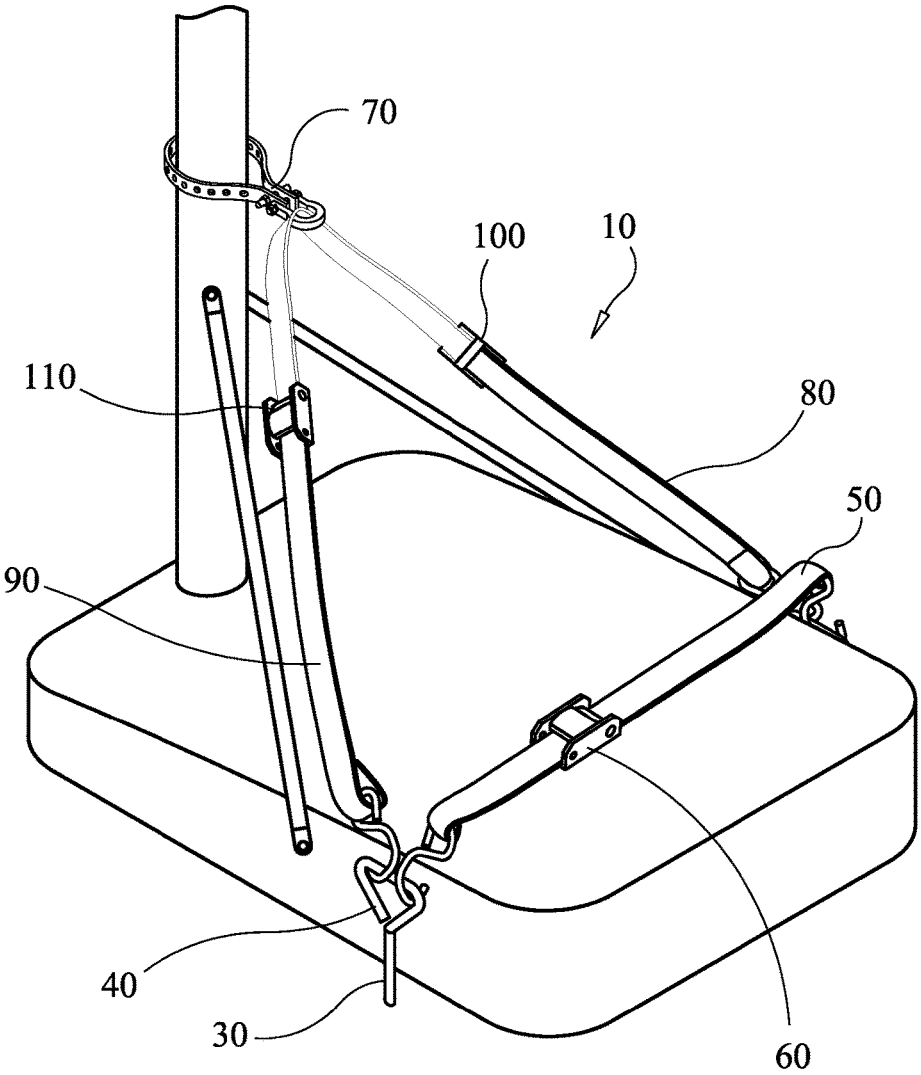
FIG. 8 shows a perspective view of another embodiment of the securing system of the present invention.

In other embodiments, strap 50 is a separate strap, however, straps 80 and 90 may be formed as a single strap 130, as shown in FIG. 4. Any of the straps described may include a buckle for loosening or tightening.

A method for securing a portable basketball pole assembly is also provided. The method includes securing a first ground securing element 20 having a receiving element 40 into an underlying portion of ground on a first lateral side of a base, securing a second ground securing element 30 having a receiving element 40 into an underlying portion of ground on a second lateral side of a base, and attaching a retaining strap 50 to the receiving element of the first ground securing element 20, extending the strap 50 over such base, and attaching another portion of the strap 50 to the receiving element 40 of the second ground securing member 30.

It is understood that the method of the present invention incorporates the various elements described above. Thus, the method contemplates attaching and securing the various elements of the system 10. In this manner, a secure, efficient, and convenient method for securing a portable basketball pole assembly is provided.

While specific embodiments have been illustrated and described, numerous modifications come to mind without significantly departing from the spirit of the invention and the scope of protection is limited by the scope of the accompanying claims.

What is claimed is:

1. A securing system for a portable basketball pole assembly comprising:

a basketball pole assembly having a base and a basketball pole extending from said base, a first ground securing member adapted to be secured in the ground on one lateral side of said base of said portable basketball pole assembly without passing through any portion of said base, and having a receiving element disposed on a top portion thereof, a second ground securing member adapted to be secured in the ground on a second lateral side of said base of said portable basketball pole assembly without passing through any portion of said base, and having a receiving element disposed on a top portion thereof, and a strap extending from said first ground securing member over said base to said second ground securing member, said strap being attachable at a first end to the receiving element of said first ground securing member, and attachable at a second end to the receiving element of said second ground securing member, said strap extending over and adjacent to a top surface of said base without passing through any portion of said base.

2. The securing system for a portable basketball pole assembly according to claim 1, wherein said first ground securing member and said second ground securing member each comprise a screw adapted to be driven into the ground, and wherein said receiving elements comprise hooks or loops on a top portion of said ground securing members.

3. The securing system for a portable basketball pole assembly according to claim 2, wherein said strap comprises strap hooks attached at its first and second ends adapted to be attached to said receiving elements.

4. The securing system for a portable basketball pole assembly according to claim 3, wherein said strap further comprises a buckle adapted to be used to loosen or tighten said strap.

5. The securing system for a portable basketball pole assembly according to claim 1, wherein said strap hooks comprise snap hooks.

6. The securing system for a portable basketball pole assembly according to claim 1, further comprising:

a pole attachment member attached to said pole at a point raised vertically from a base, a first pole strap extending from said first ground securing member to said pole attachment member, and a second pole strap extending from said second ground securing member to said pole attachment member.

7. The securing system for a portable basketball pole assembly according to claim 6, further comprising:

a third ground securing member adapted to be secured in the ground on one lateral side of a base of such a portable basketball pole assembly and having a receiving element disposed on a top portion thereof, a fourth ground securing member adapted to be secured in the ground on a second lateral side of such a base of a portable basketball pole assembly and having a receiving element disposed on a top portion thereof, and an auxiliary strap adapted to extend from said third ground securing member over such a base to said fourth ground securing member, said auxiliary strap being attachable at a first end to the receiving element of said third ground securing member, and attachable at a second end to the receiving element of said fourth ground securing member.

8. The securing system for a portable basketball pole assembly according to claim 6, wherein said first pole strap further comprises a buckle adapted to be used to loosen or tighten said first pole strap, and wherein said second pole strap further comprises a buckle adapted to be used to loosen or tighten said second pole strap.

9. The securing system for a portable basketball pole assembly according to claim 8, wherein said first pole strap comprises Nylon, and wherein said second pole strap comprise Nylon.

10. The securing system for a portable basketball pole assembly according to claim 6, wherein said pole attachment member is a metal component which wraps substantially around the pole.

11. A method for securing a portable basketball pole assembly comprising the steps of:

securing a first ground securing element having a receiving element into an underlying portion of ground on a first lateral side of a base having a basketball pole extending therefrom without passing through any portion of such a base, securing a second ground securing element having a receiving element into an underlying portion of ground on a second lateral side of such a base without passing through any portion of such a base, and attaching a retaining strap to the receiving element of said first ground securing element, extending said strap over and adjacent to a top surface of such a base without passing it through any portion of such a base, and attaching another portion of said strap to the receiving element of said second ground securing member.

12. The method for securing a portable basketball pole assembly according to claim 11, wherein said first ground securing member and said second ground securing member each comprise a screw adapted to be driven into the ground, wherein the step of securing the first ground securing element comprises driving the screw into the ground, wherein the step of securing the second ground securing element comprises driving the screw into the ground, and wherein said receiving elements comprise hooks or loops on a top portion of said ground securing members.

13. The method for securing a portable basketball pole assembly according to claim 11, further comprising the steps of:

attaching a pole attachment member to the pole at a point raised vertically from a base, attaching a first pole strap extending from said first ground securing member to said pole attachment member, and attaching a second pole strap extending from said second ground securing member to said pole attachment member.

14. The method for securing a portable basketball pole assembly according to claim 13, wherein said strap includes a buckle adapted to loosen or tighten said strap.

15. The method for securing a portable basketball pole assembly according to claim 14, wherein said first and said second pole straps further comprise buckles adapted to loosen or tighten said first and said second pole straps, respectively.

16. The method for securing a portable basketball pole assembly according to claim 13, wherein said straps comprise Nylon.

17. The method for securing a portable basketball pole assembly according to claim 11, further comprising the step of:

attaching a pole strap to said first ground securing member, extending said pole strap around said pole, and attaching said pole strap to said second ground securing member.

18. The method for securing a portable basketball pole assembly according to claim 11, further comprising the steps of:

attaching a pole strap to said first ground securing member, extending said pole strap through a pole strap securing member on said pole at a point raised above the base, and attaching said pole strap to said second ground securing member.

* * * * *